US011788035B2

(12) United States Patent
Alves De Mattos et al.

(10) Patent No.: US 11,788,035 B2
(45) Date of Patent: Oct. 17, 2023

(54) SOAP BAR WITH HIGH WATER CONTENT

(71) Applicant: Conopco, Inc., Englewood Cliffs, NJ (US)

(72) Inventors: Rodrigo Alves De Mattos, Campinas (BR); Gislene Splendore Bortolai, Campinas (BR); Nikhil J. Fernandes, Philadelphia, PA (US); Lyndsay M. Leal, Spring City, PA (US); Uwe Hagemann, Marambaia (BR); Sergio Roberto Leopoldino, Campinas (BR); Yuriy Konstantinovich Yarovoy, Monroe, CT (US)

(73) Assignee: CONOPCO, INC., Englewood Cliffs, NJ (US)

( * ) Notice: Subject to any disclaimer, the term of this patent is extended or adjusted under 35 U.S.C. 154(b) by 0 days.

(21) Appl. No.: 17/908,018

(22) PCT Filed: Feb. 23, 2021

(86) PCT No.: PCT/EP2021/054396
§ 371 (c)(1),
(2) Date: Aug. 30, 2022

(87) PCT Pub. No.: WO2021/180457
PCT Pub. Date: Sep. 16, 2021

(65) Prior Publication Data

US 2023/0094528 A1 Mar. 30, 2023

(30) Foreign Application Priority Data

Mar. 13, 2020 (EP) ..... 20163161

(51) Int. Cl.

| | |
|---|---|
| ***C11D 9/00*** | (2006.01) |
| ***C11D 9/22*** | (2006.01) |
| ***C11D 9/02*** | (2006.01) |
| ***C11D 9/10*** | (2006.01) |
| ***C11D 9/18*** | (2006.01) |
| ***C11D 9/26*** | (2006.01) |
| ***C11D 13/18*** | (2006.01) |
| ***C11D 17/00*** | (2006.01) |

(52) U.S. Cl.
CPC ..... *C11D 9/225* (2013.01); *C11D 9/02* (2013.01); *C11D 9/10* (2013.01); *C11D 9/18* (2013.01); *C11D 9/26* (2013.01); *C11D 13/18* (2013.01); *C11D 17/0065* (2013.01)

(58) Field of Classification Search
CPC ..... C11D 9/225; C11D 9/02; C11D 13/18
See application file for complete search history.

(56) References Cited

U.S. PATENT DOCUMENTS

| | | | | |
|---|---|---|---|---|
| 5,703,026 | A | 12/1997 | Setser et al. | |
| 2009/0105114 | A1* | 4/2009 | Stolte | C11D 13/16 264/71 |
| 2016/0331666 | A1 | 11/2016 | Ive et al. | |
| 2017/0049682 | A1* | 2/2017 | Bortolai | C11D 9/18 |
| 2017/0051235 | A1* | 2/2017 | Astolfi | C11D 3/2065 |
| 2020/0231904 | A1* | 7/2020 | Hoessel | C11D 17/006 |

FOREIGN PATENT DOCUMENTS

| | | |
|---|---|---|
| EP | 1465932 | 10/2004 |
| WO | WO03062288 | 7/2003 |
| WO | WO2019025257 | 2/2019 |

OTHER PUBLICATIONS

Search Report and Written Opinion in EP20163161; dated Aug. 25, 2020; European Patent Office (EPO).
Search Report and Written Opinion in PCTEP2021054396; dated Jun. 9, 2021; World Intellectual Property Org. (WIPO).
IPRP2 in PCTEP2021054396; dated Mar. 7, 2022; World Intellectual Property Org. (WIPO).

* cited by examiner

*Primary Examiner* — Necholus Ogden, Jr.
(74) *Attorney, Agent, or Firm* — Krista A. Kostiew

(57) ABSTRACT

The present invention relates to a soap bar composition. It more particularly relates to a soap bar composition which comprises low amount of soap where high amount of water can be incorporated. This is achieved by including a selective polymer therein. The soap bars of the invention are easy to extrude and stamp.

12 Claims, No Drawings

SOAP BAR WITH HIGH WATER CONTENT

CROSS REFERENCE TO RELATED APPLICATIONS

The present application is a U.S. National Phase Application under 35 U.S.C. § 371 of International Application No. PCT/EP2021/054396, filed on Feb. 23, 2021, which claims priority to European Patent Application No. 20163161.1, filed on Mar. 13, 2020, the contents of which are incorporated herein in their entireties.

FIELD OF THE INVENTION

The present invention relates to a soap bar composition. It particularly relates to fatty acid soap bars made by a rapid extrusion process. It more particularly relates to a soap bar composition that comprises high amount of water from about 20 to 40% water and yet is easy to extrude and stamp. It also ensures maintaining good quality bar properties.

BACKGROUND OF THE INVENTION

Surfactants have been used for personal wash applications for a long time. There are many categories of products in the personal wash market e.g. body wash, face wash, hand wash, soap bars, shampoos, etc. Products which are marketed as body wash, face wash and shampoos are generally in liquid form and are made of synthetic anionic surfactants. They are generally sold in plastic bottles/containers. Soap bars and hand wash products generally contain soaps. Soap bars do not need to be sold in plastic containers and are able to retain their own shape by virtue of being structured in the form of a rigid solid. Soaps bars are usually sold in cartons made of cardboard.

Soap bars are generally prepared through one of two routes. One is called the cast bar route while the other is called the milled and plodded route (also known as extrusion route). The cast bar route has inherently been very amenable in preparing low TFM (total fatty matter) bars. TFM is defined as the total amount of fatty matter, mostly fatty acids, that can be separated from a sample of soap after splitting with a mineral acid, usually hydrochloric acid. In the cast bar soaps, the soap mixture is mixed with polyhydric alcohols and poured in casts and allowed to cool and then the soap bars are removed from the casts. The cast bar route enables production at relatively lower throughput rates.

In the milled and plodded route, the soap is prepared with high water content and then spray dried to reduce the moisture content and to cool the soap after which other ingredients are added and then the soap is extruded through a plodder and optionally cut and stamped to prepare the final soap bar. The milled and plodded soaps generally have a high TFM in the range of 60 to 80 weight percent.

Milled and plodded soap bars are also known as extruded soap bars. They are composed of very many different types of soaps. Most soap compositions comprise both water insoluble as well as water soluble soaps. Their structure is generally characterized by a brick and mortar type structure. Insoluble soaps (called bricks) usually consist of higher chain C16 and C18 soaps (palmitate and stearate soap). They are generally included in soap bars to provide structuring benefits i.e. they provide shape to the bars. Soap bars also consist of water soluble soaps (which act as the mortar) which are generally unsaturated C18:1 and 18:2 sodium soap (oleate soap) in combination with short chain fatty acids (generally C8 to C12 or even up to C14 soap). Water soluble soaps generally aid in cleaning.

In addition to about the 60-80 wt % TFM, soap bars presently prepared through the extruded route for personal wash contain about 14-22 wt % water. There is a need for developing sustainable technologies where one approach is to develop soaps with lower TFM content and by increasing the water content with no compromise on the cleaning efficacy. The present inventors are aware of various attempts by the present applicants and others to reduce the fatty matter content. These technologies include approaches to structure soap bars, like inclusion of natural aluminosilicate clays like bentonite or kaolinite but they are found to not be very efficient in structuring the bars at low amounts. If one simply substitutes the TFM with higher amount of water, it causes problems during extrusion of the soap mass and further the extruded bars are sticky and cannot be stamped easily.

To counter the effect of increased water levels, it is also possible to add electrolytes to soap. The electrolyte serves to "shorten" the soap by which is meant that the soap bar increases in hardness and becomes less sticky. However, the addition of electrolytes provides its own set of negative attributes; for example, it leads to greater degree of cracking or fissures in the extruded bars (to a level unacceptable by consumer); and further can lead to formation of an electrolyte layer on the bar surface which is visible to the naked eye, a phenomenon referred to as "efflorescence".

It is thus extremely difficult to provide predominantly fatty acid soap surfactant based bars which have high levels of water, which can be extruded at speed of 200 bars per minute and higher; and which do not simultaneously suffer from the problem of undesirable cracking and/or efflorescence (electrolyte formation) during bar storage.

Unexpectedly, applicants have now found that, through use of a specific polymer especially in the presence of controlled amounts of the specific electrolytes, it is possible to provide high extrusion, high water bars while avoiding the problems of bar cracking and bar efflorescence, particularly when storing. Soap bars with inclusion of polymers e.g. acrylate polymers are known e.g. U.S. Pat. No. 5,703,026 (P&G, 1997) discloses a skin cleansing bar soap composition comprising (a) from about 40 to about 95% surfactant component comprising fatty acid soap and/or synthetic surfactant, such that the composition comprises: (i) from 0 to 95% fatty acid soap; and (ii) from 0% to about 50% synthetic surfactant; (b) particles of absorbent gellant material, dry weight basis, in the composition being from about 0.02% to about 5%, the absorbent gellant material having an extractable polymer content of less than about 25%; and (c) from about 5 to about 35% water and additionally other optional ingredients.

WO 2019/025257 discloses a soap bar comprising soap, at least one perfume oil, at least one polymer, optionally water, and optionally further known cosmetic ingredients other than the soap, the perfume oil, the polymer and the water, wherein the at least one polymer is a water-soluble polymer, wherein the polymer has a water solubility of at least 0.01 g of polymer in 100 g of water at 20° C. at one or more than one pH value in the range between (4) and (9), and wherein the at least one polymer is selected from the group consisting of a polymer in which more than 20 wt % of the repeating units of the polymer are repeating units derived from at least one ethylenically unsaturated, polymerizable monomer having at least one acid group, and a polymer comprising repeating units derived from N-vinylpyrrolidone, wherein the proportion of these repeating units in the polymer is at least 50 wt %.

The present inventors have found that inclusion of commonly available acrylate polymers does not provide as good a structuring property to soap bars as compared to the specific polymer claimed in the present invention.

It is thus an object of the present invention to provide for a low TFM soap bar which can be prepared using the extrusion route and is easily and conveniently stampable.

It is another object of the present invention to provide for a low TFM soap bar which in addition to being conveniently extrudable and stampable does not compromise on the bar integrity or sensorial properties.

SUMMARY OF THE INVENTION

The present invention relates to a soap bar composition comprising (i) 20 to 75 wt % anhydrous soap;

(ii) a polymer comprising (a) 39 to 59% by weight of the polymer, structural units of $C_{1-4}$ alkyl acrylate;

(b) 40 to 60% by weight of the polymer, structural units of (meth)acrylic acid;

(c) 1 to 10% by weight of the polymer, structural units of a specialised associative monomer having formula 1

(I)

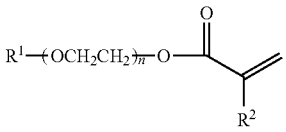

Wherein $R^1$ is a linear $C_{10-28}$ alkyl group, preferably $C_{18-26}$;

Wherein each $R^2$ is independently a hydrogen or a methyl group; and

Wherein n has a value in the range of 20 to 28; and (iii) 20 to 40 wt % water.

DETAILED DESCRIPTION OF THE INVENTION

These and other aspects, features and advantages will become apparent to those of ordinary skill in the art from a reading of the following detailed description and the appended claims. For the avoidance of doubt, any feature of one aspect of the present invention may be utilized in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description and claims indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

The present invention relates to a soap bar composition. By a soap bar composition is meant a cleansing composition comprising soap which is in the form of a shaped solid. The soap bar of the invention is useful for cleaning any surface e.g. those used for cleaning clothes (e.g. laundering) or for personal cleansing. It is especially useful for personal cleansing. The soap bar of the present invention comprises 20 to 75% soap, preferably 40 to 75%, more preferably 40 to 60 wt % soap by weight of the soap bar composition. The term soap means salt of fatty acid. Preferably, the soap is soap of C8 to C24 fatty acids. Preferably, the soap bar composition of the present is an extruded soap bar.

The cation may be an alkali metal, alkaline earth metal or ammonium ion, preferably alkali metals. Preferably, the cation is selected from sodium or potassium, more preferably sodium. The soap may be saturated or unsaturated. Saturated soaps are preferred over unsaturated soaps for stability. The oil or fatty acids may be of vegetable or animal origin.

The soap may be obtained by saponification of oils, fats or fatty acids. The fats or oils generally used to make soap bars may be selected from tallow, tallow stearins, palm oil, palm stearins, soya bean oil, fish oil, castor oil, rice bran oil, sunflower oil, coconut oil, babassu oil, and palm kernel oil. The fatty acids may be from coconut, rice bran, groundnut, tallow, palm, palm kernel, cotton seed or soyabean.

The fatty acid soaps may also be synthetically prepared (e.g. by the oxidation of petroleum or by the hydrogenation of carbon monoxide by the Fischer-Tropsch process). Resin acids, such as those present in tall oil, may also be used. Naphthenic acids may also be used.

The soap bar may additionally comprise synthetic surfactants selected from one or more from the class of anionic, non-ionic, cationic or zwitterionic surfactants, preferably from anionic surfactants. These synthetic surfactants, as per the present invention, are included in less than 8%, preferably less than 4%, more preferably less than 1% and sometimes absent from the composition.

The composition of the present invention is in the form of a shaped solid for example a bar. The cleaning soap composition is a wash off product that generally has a sufficient amount of surfactants included therein that it is used for cleansing the desired surface like topical surface e.g. the whole body, the hair and scalp or the face. It is applied on the topical surface and left thereon only for a few seconds or minutes and washed off thereafter with copious amounts of water. Alternately it may be used for laundering clothes. The soap bar is usually rubbed on to the wet clothes, optionally brushed and then rinsed with water to remove the residual soap and dirt.

The soap bars of the present invention preferably includes low molecular weight soaps (C8 to C14 soaps) which are generally water soluble, which are in the range of 2 to 20% by weight of the composition. It is preferred that the soap bar includes 15 to 55 wt % of the soap of C16 to C24 fatty acid, which are generally water insoluble soaps. Unsaturated fatty acid soaps preferably at 15 to 35% may also be included in the total soap content of the composition. Unsaturated soaps are preferably oleic acid soaps.

In an especially preferred aspect, the soap bar comprises 20 to 75%, preferably 25 or 30 or 31 or 32 or 35 or 40% on lower level to 70% or 65% by wt. on upper level anhydrous soap. The $C_{18}$ to $C_{24}$ saturated soap in such bar composition comprises 12 to 45% by wt. of total bar.

Preferably short chain $C_8$ to $C_{14}$ fatty acid soaps are included at 2 to 20% by wt. of total bar. Also preferably unsaturated $C_{18}$ fatty acid having, one, two or three unsaturated groups in the $C_{18}$ chain comprises 6% to 35%, more preferably 12 to 35% by wt. of total bar.

It is also possible to replace a part of the soaps with solvent (e.g. glycerine) without compromising on cleansing. This can also reduce the costs of the bar and could also bring additional benefits for consumers, such as mildness. In such bars, it is preferred that the ratio of [soap] to [water plus any water-soluble solvent] which may be present (polyol such as glycerine or sorbitol) is in a ratio of 0.5:1 to 5:1, preferably 1:1 to 3:1. Since it is typically preferred to have less soap and more water, ratios on the lower end (1:1 to 2:1) are particularly preferred.

The novel structurant in bars of the present invention is a polymer comprising:

(a) 39 to 59% by weight of the polymer (preferably 44 to 58%, more preferably 47 to 55%, most preferably 48 to 52%) structural units of C1-4 alkyl acrylate;

(b) 40 to 60% by weight of the polymer (preferably 40.5 to 55%, more preferably 41 to 50%, most preferably 41.5 to 45%) structural units of (meth)acrylic acid;

(c) 1 to 10% by weight of the polymer (preferably 2.5 to 7.5%, more preferably 3 to 7%, most preferably 3.5 to 6% structural units of a specialised associative monomer having formula 1

(I)

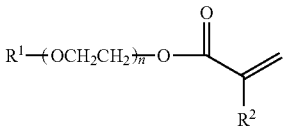

Wherein R1 is a linear C10-28 alkyl group, preferably C18-26, more preferably C20-24, most preferably C21-23;

Wherein each R2 is independently a hydrogen or a methyl group, preferably at least 80 mol % of the R2 groups are a methyl group; more preferably wherein at least 95 mol % of the R2 groups are a methyl group; further more preferably wherein at least 99 mol % of the R2 groups are a methyl group; and Wherein n has a value in the range of 20 to 28 (preferably 22 to 26; more preferably 23 to 27; most preferably 24 to 26).

By n having a value in the range of 20 to 28 is meant that the average value of n is to lie in this range. It is possible that the associative monomer of formula 1 above is prepared by a process where the chain length of the $(OCH_2CH_2)$ group varies in a certain range but the average value of the chain lengths is a value in the range of 20 to 28.

The most preferred polymer for structuring the bars of the invention comprises (a) 49.7 to 51.8% by weight of the polymer of structural units of ethyl acrylate;

(b) 41.5 to 43.3 wt % structural units of (meth)acrylic acid, wherein 95 to 100 wt % of the structural units of (meth)acrylic acid are structural units of methacrylic acid; and (c) 4.5 to 4.7 wt % structural units of a specialised associative monomer having the formula 1

(I)

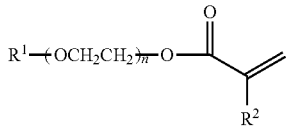

Wherein $R^1$ is a linear $C_{22}$ alkyl group;

Wherein each $R^2$ is a hydrogen or a methyl group, wherein 80 to 100 mol % of the $R^2$ groups are methyl groups; and Wherein n has a value in the range of 24 to 26.

The polymer is preferably included in 0.01 to 5% more preferably 0.05 to 3%, and most preferably 0.1 to 2% by weight of the soap bar composition.

While the polymer of the present invention structures water in soap, it is preferred that the composition includes electrolytes. While electrolytes are known to harden bars, they typically result in extruded bars which are so hard and brittle they have excessive cracking and/or provide efflorescence (layer of electrolyte) on the bar surface, particularly on storage.

The present inventors have found that the polymer as disclosed herein is especially useful if the bar includes specific types and amounts of electrolytes. With the electrolyte system described below, bars can be extruded and stamped at high rate while avoiding excessive cracking and efflorescence. The bars have defined minimal hardness and low stickiness scores.

Electrolytes as per this invention include compounds that substantially dissociate into ions in water. Electrolytes as per this invention are not ionic surfactants. Suitable electrolytes for inclusion in the soap making process are alkali metal salts. Preferred alkali metal salts for inclusion in the composition of the invention include sodium sulfate, sodium chloride, sodium acetate, sodium citrate, potassium chloride, potassium sulfate, sodium carbonate and other mono or di or tri salts of alkaline earth metals, more preferred electrolytes are sodium chloride, sodium sulfate, sodium citrate, potassium chloride and especially preferred electrolyte is sodium chloride, sodium citrate or sodium sulphate or a combination thereof. For the avoidance of doubt, it is clarified that the electrolyte is a non-soap material. It is especially preferred that the soap bar composition of the invention includes an electrolyte system as defined below.

The electrolyte system is a specific combination of alkali metal chloride (in defined amounts) together with secondary electrolyte which can be alkali metal citrate, alkali metal sulfate, or mixtures of the citrate and sulfate, wherein the secondary electrolyte(s) is also used in specific defined amounts whether alone or as a mixture. The alkali metal may be sodium or potassium preferably sodium.

The amount of electrolyte providing this benefit is defined as follows:

1. [alkali metal chloride] %=0.075×[water]−0.626; and
2. [alkali metal citrate] %=−0.0023×[water]$^2$+0.312×[water]−4.34;

[alkali metal sulfate] %=−0.0023×[water]$^2$+0.312×[water]− 4.34; or

[alkali metal citrate plus alkali metal sulfate] %=−0.0023×[water]$^2$+0.312×[water]−4.34, wherein the calculated amount of the concentration of the electrolyte is plus or minus 15% (e.g., if calculated concentration of sodium chloride is 0.86 based on the formula, it may be based at level of 0.86±0.129% by wt. The calculated amount of the concentration of the electrolyte is preferably plus or minus 10%, furthermore preferably plus or minus 5%.

Based on the above formula, developed with extensive experimentation by the inventors, the preferred amounts of electrolytes for various preferred range of water is summarised below:

Water from 20 to 40 wt % of the bar:

Sodium chloride could be included in the range of 0.74 to 2.73%, preferably 0.79 to 2.61%, most preferably 0.83 to 2.49% by weight of the bar.

Sodium sulphate or sodium citrate or a combination of the two could be included in 0.83 to 5.13%, preferably 0.88 to 4.91%, most preferably 0.93 to 4.68% by weight of the bar.

Water from 20 to 35 wt % of the bar:

Sodium chloride could be included in the range of 0.74 to 2.30%, preferably 0.79 to 2.20%, most preferably 0.83 to 2.10% by weight of the bar.

Sodium sulphate or sodium citrate or a combination of the two could be included in 0.83 to 4.33%, preferably 0.88 to 4.14%, most preferably 0.93 to 3.95% by weight of the bar.

Water from 25 to 35 wt % of the bar:

Sodium chloride could be included in the range of 1.06 to 2.30%, preferably 1.12 to 2.20%, most preferably 1.19 to 2.10% by weight of the bar.

Sodium sulphate or sodium citrate or a combination of the two could be included in 1.72 to 4.33%, preferably 1.82 to 4.14%, most preferably 1.92 to 3.95% by weight of the bar.

The soap bar composition of the invention preferably comprises an electrolyte.

In total, the electrolyte is preferably included in 0.1 to 8%, more preferably 0.5 to 6%, even more preferably 0.5 to 5%, furthermore preferably 0.5 to 3%, and most preferably 1 to 3% by weight of the composition. It is preferred that the electrolyte is included in the soap bar during the step of saponification to form the soap.

The high levels of water used in the bars of the invention are in the range of 20% to 40%, preferably 25% to 40%, preferably 26% or 27% or 28% or 29% or 30% by wt. as lower limit and 39 or 38 or 37 or 36 or 35% as upper limit, where any lower limit can be used interchangeably with any upper limit. If such high amount of water were used in bars previously known in the art, it typically results in bars which are soft and tacky (compared to bars of our invention which are defined by a certain minimum hardness and low stickiness score). Such bars, previously known in the art, have difficulty extruding and stamping at a high extrusion rate of 200 bars per minute and greater.

Using such defined components (Soap, polymer, electrolyte amounts; ratio of soap to water and optional solvent), we can obtain bars which are extruded at 200 or more bars/minute and have hardness value of 1.2 Kg to 5.0 Kg (measured at 40° C.); low stickiness and cracking, and which bars are free of visible efflorescence.

In addition to the long, saturated soaps which act as structurants, bars of the invention may optionally comprise 0.05 to 35% structurants. Use of more structurants permits lower ratio of [soap] to [water soluble solvent e.g. polyol plus water] if desired.

The structurant may include one or more structurants such as starches, sodium carboxymethylcellulose, inorganic particulate matter (e.g., talc, calcium carbonate, zeolite and mixtures of such particulates) and mixtures thereof. The combined level of $C_{16}$ to $C_{24}$ long chain structurants and structurants noted above is preferably higher than 25%, preferably, 25% to 40%.

The composition of the invention may comprise selective amount of zeolite which is in the range of 3 to 20%, preferably 5 to 15% by weight of the composition. Zeolites are hydrated aluminosilicates. Their structure consists in a three dimensional framework of interlinked tetrahydra of $AlO_4$ and $SiO_4$ coordinated by oxygen atoms. Zeolites are solids with a relatively open, three-dimensional crystal structure built from the elements aluminum, oxygen, and silicon, with alkali or alkaline-earth metals (such as sodium, potassium, or magnesium) with water molecules trapped in the gaps between them. Zeolites form with many different crystalline structures, which have large open pores (sometimes referred to as cavities) in a very regular arrangement and roughly the same size as small molecules.

The structural formula of zeolite based on its crystal unit cell (assuming both the $SiO_2$ and $AlO_2$ as variables) can be represented by $$M_{a/n}(AlO_2)_a(SiO_2)_b \cdot wH_2O$$

Where M is the cation (e.g sodium, potassium or magnesium), w is the number of water molecules per unit cell, and a and b are total number of tetrahedra of Al and Si, respectively per unit cell; and n is valency of the metal ion. The ratio of b/a usually varies from 1 to 5.

E.g. for Mordenite the chemical formula is $Na_8\ (AlO_2)_8\ (SiO_2)_{40}$

Where a=8 and b=40; b/a is 5.

For Zeolite 4A, the chemical formula is $Na_{96}\ (AlO_2)_{96}\ (SiO_2)_{96}$

Where a=96 and b=96; b/a is 1.

Some zeolites have b/a value which vary from 10 to 100 or even higher e.g. for ZSM-5 type of zeolite.

As per this invention zeolites which are preferred for use in the soap composition include Zeolite 4A, Zeolite 5A, Zeolite 13A or Zeolite 3A. The most preferred Zeolite is Zeolite 4A.

The composition of the invention preferably comprises a silicate compound preferably sodium silicate or calcium silicate, more preferably sodium silicate. Sodium silicate includes compounds having the formula $(Na_2O)_x \cdot SiO_2$. The weight ratio of $Na_2O$ to $SiO_2$ could vary from 1:2 to 1:3.75. Grades of sodium silicate with ratio from about 1:2 to 1:2.85 are called alkaline silicate and with ratios from 1:2.85 to about 1:3.75 are called neutral silicate. Forms of sodium silicate that are available include sodium metasilicate ($Na_2SiO_3$), sodium pyrosilicate ($Na_6Si_2O_7$), and sodium orthosilicate ($Na_4SiO_4$). It is preferred as per this invention that alkaline sodium silicate is used. Especially preferred is alkaline sodium silicate with a ratio of 1:2. It is preferred that the soap bar comprises 0.1% to 10 wt % sodium silicate or calcium silicate, on dry weight basis.

The soap bar composition may optionally contain some free fatty acids. When included, free fatty acids comprise 0.1 to 15%, preferably 0.5 to 12% by weight of free fatty acids. By free fatty acids is meant a carboxylic acid comprising a hydrocarbon chain and a terminal carboxyl group bonded to an H. Suitable fatty acids are C8 to C22 fatty acids. Preferred fatty acids are C12 to C18, preferably predominantly saturated, straight-chain fatty acids. However, some unsaturated fatty acids can also be employed.

The composition preferably comprises a polyhydric alcohol (also called polyol) or mixture of polyols. Polyol is a term used herein to designate a compound having multiple hydroxyl groups (at least two, preferably at least three) which is highly water soluble. Many types of polyols are available including: relatively low molecular weight short chain polyhydroxy compounds such as glycerol and propylene glycol; sugars such as sorbitol, manitol, sucrose and glucose; modified carbohydrates such as hydrolyzed starch, dextrin and maltodextrin, and polymeric synthetic polyols such as polyalkylene glycols, for example polyoxyethylene glycol (PEG) and polyoxypropylene glycol (PPG). Especially preferred polyols are glycerol, sorbitol and their mixtures. Most preferred polyol is glycerol. In a preferred embodiment, the bars of the invention comprise 0 to 8%, preferably 1 to 7.5% by wt. polyol.

The soap composition may be made into a bar by a process that first involves saponification of the fat charge with alkali followed by mixing with the polymer and water and then extruding the mixture in a conventional plodder. The plodded mass may then be optionally cut to a desired size and stamped with a desirable indicia. An especially important benefit of the present invention is that, notwithstanding the high amount of water content of the soap bar, compositions thus prepared by extrusion are found to be easy to stamp with a desirable indicia.

By "easy to extrude" is meant that the hardness of the bar as it is extruded is high enough that it exits the extruder in a firm enough form that it can be called a rigid bar. The hardness of the bar is preferably higher than 1.2 kg, more preferably in the range of 1.2 to 5.0 kg (at 40° C.). The hardness is preferably measured using the TA-XT Express apparatus available from Stable Micro Systems. The hardness is measured using this apparatus with a 30° conical probe—Part #P/30c to a penetration of 15 mm. If the soap mass is too soft and is passed through the extruder it will not extrude out of the extruder in a cohesive enough mass to be called a bar. By "easy to stamp" is meant that the soap bar is of such a consistency and low enough stickiness that it does not stick to the die that is used to stamp any desired indicia on the bar. The soap bar prepared by the process of the invention therefore preferably comprises an indicium stamped thereupon.

The various optional ingredients that make up the final soap bar composition are as described below:

Organic and Inorganic Adjuvant Materials

The total level of the adjuvant materials used in the bar composition should be in an amount not higher than 50%, preferably 1 to 50%, more preferably 3 to 45% by wt. of the soap bar composition.

Suitable starchy materials which may be used include natural starch (from corn, wheat, rice, potato, tapioca and the like), pregelatinized starch, various physically and chemically modified starch and mixtures thereof. By the term natural starch is meant starch which has not been subjected to chemical or physical modification—also known as raw or native starch. The raw starch can be used directly or modified during the process of making the bar composition such that the starch becomes gelatinized, either partially or fully gelatinized.

The adjuvant system may optionally include insoluble particles comprising one or a combination of materials. By insoluble particles is meant materials that are present in solid particulate form and suitable for personal washing. Preferably, there are mineral (e.g., inorganic) or organic particles.

The insoluble particles should not be perceived as scratchy or granular and thus should have a particle size less than 300 microns, more preferably less than 100 microns and most preferably less than 50 microns.

Preferred inorganic particulate material includes talc and calcium carbonate. Talc is a magnesium silicate mineral material, with a sheet silicate structure and a composition of $Mg_3Si_4(OH)_{22}$ and may be available in the hydrated form. It has a plate-like morphology, and is essentially oleophilic/hydrophobic, i.e., it is wetted by oil rather than water.

Calcium carbonate or chalk exists in three crystal forms: calcite, aragonite and vaterite. The natural morphology of calcite is rhombohedral or cuboidal, acicular or dendritic for aragonite and spheroidal for vaterite.

Examples of other optional insoluble inorganic particulate materials include aluminates, silicates, phosphates, insoluble sulfates, and clays (e.g., kaolin, china clay) and their combinations.

Organic particulate materials include: insoluble polysaccharides such as highly crosslinked or insolubilized starch (e.g., by reaction with a hydrophobe such as octyl succinate) and cellulose; synthetic polymers such as various polymer lattices and suspension polymers; insoluble soaps and mixtures thereof.

Bar compositions preferably comprise 0.1 to 25% by wt. of bar composition, preferably 5 to 15 by wt. of these mineral or organic particles.

An opacifier may be optionally present in the personal care composition. When opacifiers are present, the cleansing bar is generally opaque. Examples of opacifiers include titanium dioxide, zinc oxide and the like. A particularly preferred opacifier that can be employed when an opaque soap composition is desired is ethylene glycol mono- or di-stearate, for example in the form of a 20% solution in sodium lauryl ether sulphate. An alternative opacifying agent is zinc stearate.

The product can take the form of a water-clear, i.e. transparent soap, in which case it will not contain an opacifier.

The pH of preferred soaps bars of the invention is from 8 to 11, more preferably 9 to 11.

A preferred bar may additionally include up to 30 wt % benefit agents. Preferred benefit agents include moisturizers, emollients, sunscreens and anti-ageing compounds. The agents may be added at an appropriate step during the process of making the bars. Some benefit agents may be introduced as macro domains.

Other optional ingredients like anti-oxidants, perfumes, polymers, chelating agents, colourants, deodorants, dyes, enzymes, foam boosters, germicides, anti-microbials, lathering agents, pearlescers, skin conditioners, stabilizers or superfatting agents, may be added in suitable amounts in the process of the invention. Preferably, the ingredients are added after the saponification step. Sodium metabisulphite, ethylene diamine tetra acetic acid (EDTA), or ethylene hydroxy diphosphonic acid (EHDP) are preferably added to the formulation.

The composition of the invention could be used to deliver antimicrobial benefits. Antimicrobial agents that are preferably included to deliver this benefits include oligodynamic metals or compounds thereof. Preferred metals are silver, copper, zinc, gold or aluminium. Silver is particularly preferred. In the ionic form it may exist as a salt or any compound in any applicable oxidation state. Preferred silver compounds are silver oxide, silver nitrate, silver acetate, silver sulfate, silver benzoate, silver salicylate, silver carbonate, silver citrate or silver phosphate, with silver oxide, silver sulfate and silver citrate being of particular interest in one or more embodiments. In at least one preferred embodiment the silver compound is silver oxide. Oligodynamic metal or a compound thereof is preferably included in 0.0001 to 2%, preferably 0.001 to 1% by weight of the composition. Alternately an essential oil antimicrobial active may be included in the composition of the invention. Preferred essential oil actives which may be included are terpineol, thymol, carvacol, (E)-2(prop-1-enyl) phenol, 2-propylphenol, 4-pentylphenol, 4-sec-butylphenol, 2-benzyl phenol, eugenol or combinations thereof. Furthermore, preferred essential oil actives are terpineol, thymol, carvacrol or thymol, most preferred being terpineol or thymol and ideally a combination of the two. Essential oil actives are preferably included in 0.001 to 1%, preferably 0.01 to 0.5% by weight of the composition.

The invention will now be illustrated by means of the following non-limiting examples.

EXAMPLES

Example A-C and 1-3: Effect of Soap Bars Outside and within the Invention on Hardness of the Bars The following six soap bar compositions as shown in Table-1 were prepared. The hardness of each soap bar was measured using the following procedure:

Hardness Testing Protocol

Principle

A 30° conical probe penetrates into a soap/syndet sample at a specified speed to a pre-determined depth. The resistance generated at the specific depth is recorded. There is no size or weight requirement of the tested sample except that the bar/billet be bigger than the penetration of the cone (15 mm) and have enough area. The recorded resistance number is also related to the yield stress and the stress can be calculated as noted below. The hardness (and/or calculated yield stress) can be measured by a variety of different penetrometer methods. In this invention, as noted above, we use probe which penetrates to depth of 15 mm.

Apparatus and Equipment

TA-XT Express (Stable Micro Systems)

30° conical probe—Part #P/30c (Stable Micro Systems)

Sampling Technique

This test can be applied to billets from a plodder, finished bars, or small pieces of soap/syndet (noodles, pellets, or bits). In the case of billets, pieces of a suitable size (9 cm) for the TA-XT can be cut out from a larger sample. In the case of pellets or bits which are too small to be mounted in the TA-XT, the compression fixture is used to form several noodles into a single pastille large enough to be tested.

Procedure

Setting up the TA-XT Express

These settings need to be inserted in the system only once. They are saved and loaded whenever the instrument is turned on again. This ensures settings are constant and that all experimental results are readily reproducible.

Set test method

Press MENU

Select TEST SETTINGS (Press 1)

Select TEST TPE (Press 1)

Choose option 1 (CYCLE TEST) and press OK

Press MENU

Select TEST SETTINGS (Press 1)

Select PARAMETERS (Press 2)

Select PRE TEST SPEED (Press 1)

Type 2 (mm $s^{-1}$) and press OK

Select TRIGGER FORCE (Press 2)

Type 5 (g) and Press OK

Select TEST SPEED (Press 3)

Type 1 (mm $s^{-1}$) and press OK

Select RETURN SPEED (Press 4)

Type 10 (mm $s^{-1}$) and press OK

Select DISTANCE (Press 5)

Type 15 (mm) for soap billets or 3 (mm) for soap pastilles and press OK

Select TIME (Press 6)

Type 1 (CYCLE)

Calibration

Screw the probe onto the probe carrier.

Press MENU

Select OPTIONS (Press 3)

Select CALIBRATE FORCE (Press 1)—the instrument asks for the user to check whether the calibration platform is clear Press OK to continue and wait until the instrument is ready.

Place the 2 kg calibration weight onto the calibration platform and press OK

Wait until the message "calibration completed" is displayed and remove the weight from the platform.

Sample Measurements

Place the billet onto the test platform.

Place the probe close to the surface of the billet (without touching it) by pressing the UP or DOWN arrows.

Press RUN

Take the readings (g or kg) at the target distance (Fin).

After the run is performed, the probe returns to its original position.

Remove the sample from the platform and record its temperature.

Calculation & Expression of Results

Output

The output from this test is the readout of the TA-XT as "force" ($R_T$) in g or kg at the target penetration distance, combined with the sample temperature measurement. (In the subject invention, the force is measured in Kg at 40° C. at 15 mm distance)

The force reading can be converted to extensional stress, according to the equation below:

The equation to convert the TX-XT readout to extensional stress is $$\sigma = \frac{1}{C}\frac{R_T g_c}{A}$$

where: $\sigma$=extensional stress

C="constraint factor" (1.5 for 30° cone)

$G_c$=acceleration of gravity

A=projected area of cone=$\pi(d \tan \frac{1}{2}\theta)^2$ d=penetration depth $\theta$=cone angle For a 30° cone at 15 mm penetration Equation 2 becomes $$\sigma(\text{Pa}) = R_T(\text{g}) \times 128.8$$

This stress is equivalent to the static yield stress as measured by penetrometer.

The extension rate is $$\dot{\varepsilon} = \frac{V}{d \tan\left(\frac{1}{2}\theta\right)}$$

where $\dot{\varepsilon}$=extension rate ($s^{-1}$)

V=cone velocity

For a 30° cone moving at 1 mm/s, $\dot{\varepsilon}$=0.249 $s^{-1}$

Temperature Correction

The hardness (yield stress) of skin cleansing bar formulations is temperature-sensitive.

For meaningful comparisons, the reading at the target distance ($R_T$) should be corrected to a standard reference temperature (normally 40° C.), according to the following equation:

$$R_{40}=R_T\times\exp[\alpha(T-40)]$$

where $R_{40}$=reading at the reference temperature (40° C.)

$R_T$=reading at the temperature T

α=coefficient for temperature correction

T=temperature at which the sample was analyzed.

The correction can be applied to the extensional stress.

Raw and Processed Data

The final result is the temperature-corrected force or stress, but it is advisable to record the instrument reading and the sample temperature also.

A hardness value of at least 1.2 Kg (measured at 40° C.) is acceptable.

TABLE 1

| Ingredient (wt %) | A | 1 | B | 2 | C | 3 |
|---|---|---|---|---|---|---|
| Sodium anhydrous soap* | 56.8 | 58.3 | 57.3 | 57.3 | 56.3 | 56.3 |
| Water | 29.0 | 29.0 | 30.0 | 30.0 | 31.0 | 31.0 |
| Glycerin | 6.0 | 6.0 | 6.0 | 6.0 | 6.0 | 6.0 |
| Sodium chloride | 1.6 | 1.6 | 1.6 | 1.6 | 1.6 | 1.6 |
| Sodium citrate | 3.0 | 3.0 | 3.0 | 3.0 | 3.0 | 3.0 |
| Aculyn 28 | 2.0 | — | 0.5 | — | 0.5 | |
| Polymer as per the invention | — | 0.5 | — | 0.5 | — | 0.5 |
| Minor ingredients (colourants, perfume, preservative etc) | 1.6 | 1.6 | 1.6 | 1.6 | 1.6 | 1.6 |
| Hardness | 1.6 | 2.0 | 1.4 | 1.8 | 1.4 | 1.6 |

*The fat blend to prepare the soap was 80% non-lauric and 20% lauric of vegetable origin The data in the above table indicates that compositions within the invention (Examples 1 to 3) provide for harder soaps when the polymer of the invention is used instead of a well-known commercially available polyacrylate polymer (Aculyn 28) (Examples A to C) at the same respective water concentration.

The invention claimed is:

1. A soap bar composition comprising (i) 20 to 75 wt % anhydrous soap;

(ii) a polymer comprising (a) 39 to 59% by weight of the polymer, structural units of $C_{1-4}$ alkyl acrylate;

(b) 40 to 60% by weight of the polymer structural units of (meth)acrylic acid;

(c) 1 to 10% by weight of the polymer structural units of a specialised associative monomer having formula 1

(I)

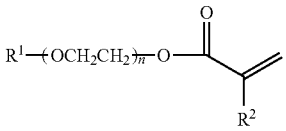

Wherein $R^1$ is a linear $C_{10-28}$ alkyl group;

Wherein each $R^2$ is independently a hydrogen or a methyl group; and

Wherein n has a value in the range of 20 to 28;

(iii) 25 to 40 wt % water; and (iv) 0.1 to 8 wt % of an electrolyte;

wherein the electrolyte is a combination of alkali metal chloride; and a secondary electrolyte selected from the group consisting of alkali metal citrate and alkali metal sulfate; and wherein the concentration of alkali metal chloride ([alkali metal chloride]);

and of alkali metal citrate ([alkali metal citrate]), alkali metal sulfate ([alkali metal sulfate]) is defined by level of water we use, as follows:

1. [alkali metal chloride] %=0.075×[water]−0.626; and
2. [alkali metal citrate] %=−0.0023×[water]2+0.312×[water]−4.34;
3. [alkali metal sulfate] %=−0.0023×[water]2+0.312×[water]−4.34; or
4. [alkali metal citrate and alkali metal sulfate]=−0.0023×[water]2+0.312×[water]−4.34, wherein the calculated amount of the concentration of the electrolyte is plus or minus 15%.

2. The soap bar composition as claimed in claim 1, wherein the polymer comprises (a) 49.7 to 51.8% by weight of the polymer of structural units of ethyl acrylate;

(b) 41.5 to 43.3% by weight of the polymer of structural units of (meth)acrylic acid, wherein 95 to 100 wt % of the structural units of (meth)acrylic acid are structural units of methacrylic acid; and (c) 4.5 to 4.7%, by weight of the polymer of structural units of a specialised associative monomer having the formula 1

(I)

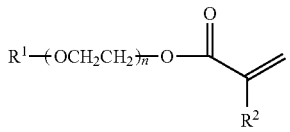

Wherein $R^1$ is a linear $C_{22}$ alkyl group;

Wherein each $R^2$ is a hydrogen or a methyl group, wherein 80 to 100 mol % of the $R^2$ groups are methyl groups; and Wherein n has a value in the range of 24 to 26.

3. The soap bar composition as claimed in claim 1, additionally comprising 5 to 15 wt % zeolite.

4. The soap bar composition as claimed in claim 1, additionally comprising 0.1 to 10 wt % of sodium or calcium silicate.

5. The soap bar composition as claimed in claim 1, comprising 12 to 45% of $C_{16}$ to $C_{24}$ saturated soap by total weight of the bar.

6. The soap bar composition as claimed in claim 1, additionally comprising one or more structurants selected from starch, carboxymethylcellulose, or inorganic particulates.

7. The soap bar composition as claimed in claim 1, comprising 0.01 to 5% polymer by weight of the soap bar.

8. The soap bar composition as claimed in claim 1, wherein the bar has a hardness value of 1.2 Kg to 5.0 Kg (measured at 40° C. by a TA-XT Express Apparatus with a 30° conical probe—Part #P/30c to a penetration of 15 mm) of 15 mm.

9. A process to prepare a soap bar composition as claimed in claim 1, comprising the step of saponification of the fat charge with alkali followed by mixing with the polymer and water and then extruding the mixture in a plodder.

10. The process as claimed in claim 9, wherein the soap bar is easy to extrude and stamp, wherein the soap bar has a hardness higher than 1.2 kg measured at 40° C., with a TA-XT Express Apparatus with a 30° conical probe—Part #P/30c to a penetration of 15 mm.

11. A soap bar as claimed in claim 1, wherein the electrolyte comprises sodium sulfate, sodium chloride, sodium acetate, sodium citrate, potassium chloride, potassium sulfate, sodium carbonate and other mono or di or tri salts of alkaline earth metals, preferably wherein the electrolyte comprises sodium chloride, sodium sulfate, sodium citrate, potassium chloride, and more preferably electrolyte is sodium chloride, sodium citrate or sodium sulphate or a combination thereof.

12. The process as claimed in claim 10, wherein the hardness is 1.2 to 5.0 kg.

* * * * *